US008726443B2

(12) United States Patent
Freel et al.

(10) Patent No.: US 8,726,443 B2
(45) Date of Patent: May 20, 2014

(54) MITIGATION OF DEPOSITS AND SECONDARY REACTIONS IN THERMAL CONVERSION PROCESSES

(75) Inventors: Barry Freel, Greely (CA); Geoffrey Hopkins, Greely (CA)

(73) Assignee: Ensyn Renewables, Inc., Wilmington, DE (US)

( * ) Notice: Subject to any disclaimer, the term of this patent is extended or adjusted under 35 U.S.C. 154(b) by 425 days.

(21) Appl. No.: 12/791,145

(22) Filed: Jun. 1, 2010

(65) Prior Publication Data

US 2010/0236915 A1 Sep. 23, 2010

Related U.S. Application Data

(62) Division of application No. 12/110,197, filed on Apr. 25, 2008, now Pat. No. 8,097,090.

(51) Int. Cl.
*B08B 1/00* (2006.01)
*B08B 9/04* (2006.01)

(52) U.S. Cl.
USPC ..... 15/104.05; 15/104.14

(58) Field of Classification Search
USPC ..... 15/104.05, 104.096, 104.11, 104.14; 266/97, 148; 134/8
See application file for complete search history.

(56) References Cited

U.S. PATENT DOCUMENTS

| | | | | |
|---|---|---|---|---|
| 1,252,072 | A | | 1/1918 | Abbot |
| 2,205,757 | A | * | 6/1940 | Wheat ..... 15/104.096 |
| 2,326,525 | A | | 8/1943 | Diwoky |
| 2,382,202 | A | | 8/1943 | Doerner |
| 2,380,098 | A | * | 7/1945 | Doerner ..... 266/97 |
| 2,696,979 | A | | 12/1954 | Berge |
| 3,467,502 | A | * | 9/1969 | Davis ..... 422/112 |
| 3,907,661 | A | | 9/1975 | Gwyn et al. |
| 4,233,119 | A | | 11/1980 | Meyers et al. |
| 4,321,096 | A | | 3/1982 | Dobbin |
| 4,617,693 | A | | 10/1986 | Meyer et al. |
| 5,402,548 | A | | 4/1995 | Adair et al. |
| 5,426,807 | A | | 6/1995 | Grimsley et al. |
| 6,988,453 | B2 | | 1/2006 | Cole et al. |

* cited by examiner

*Primary Examiner* — Saeed T Chaudhry
(74) *Attorney, Agent, or Firm* — Jones Day

(57) ABSTRACT

Described herein are systems and methods for reducing cumulative deposition and unwanted secondary thermal reactions in pyrolysis and other thermal conversion processes. In an embodiment, a system comprises a device, referred to as a reamer, for removing product deposits between thermal conversion and condensation operations of a pyrolysis process. The reamer may comprise, but is not limited to, a mechanical reciprocating rod or ram, a mechanical auger, a drill bit, a high-temperature wiper, brush, or punch to remove deposits and prevent secondary reactions. Alternatively or in addition, the reamer may use a high-velocity curtain or jet (i.e., a hydraulic or pneumatic stream) of vapor, product gas, recycle gas, other gas jet or non-condensing liquid to remove deposits. Preferably, the reamer removes deposits during the pyrolysis process allowing for continuous operation of the pyrolysis process.

6 Claims, 7 Drawing Sheets

MITIGATION OF DEPOSITS AND SECONDARY REACTIONS IN THERMAL CONVERSION PROCESSES

CROSS-REFERENCE TO RELATED APPLICATION

This application is a divisional of U.S. application Ser. No. 12/110,197, filed Apr. 25, 2008, now U.S. Pat. No. 8,097,090, which application is fully incorporated herein by reference.

FIELD OF THE INVENTION

The present invention is related to pyrolysis and other thermal conversion processes, and more particular to systems and method for reducing deposits and mitigating secondary reactions in pyrolysis and other thermal conversion processes.

BACKGROUND OF THE INVENTION

Biomass has been the primary source of energy over most of human history. During the 1800's and 1900's the proportion of the world's energy sourced from biomass dropped sharply, as the economical development of fossil fuels occurred, and markets for coal and petroleum products took over. Nevertheless, some 15% of the world's energy continues to be sourced from biomass, and in the developing world, the contribution of biomass to the energy supply is close to 38%.

Solid biomass, typically wood and wood residues, is converted to useful products, e.g., fuels or chemicals, by the application of heat. The most common example of thermal conversion is combustion, where air is added and the entire biomass feed material is burned to give hot combustion gases for the production of heat and steam. A second example is gasification, where a small portion of the biomass feedstock is combusted with air in order to convert the rest of the biomass into a combustible fuel gas. The combustible gas, known as producer gas, behaves like natural gas but typically has between 10 and 30% of the energy content of natural gas. A final example of thermal conversion is pyrolysis where the solid biomass is converted to liquid and char, along with a gaseous by-product, essentially in the absence of air.

In a generic sense, pyrolysis or thermal cracking is the conversion of biomass, fossil fuels and other carbonaceous feedstocks to a liquid and/or char by the action of heat, normally without using direct combustion in a conversion unit. A small quantity of combustible gas is also a typical by-product. Historically, pyrolysis was a relatively slow process where the resulting liquid product was a viscous tar and "pyrolygneous" liquor. Conventional slow pyrolysis has typically taken place at temperatures below 400° C. and at processing times ranging from several seconds to minutes prior to the unit operations of condensing the product vapors into a liquid product. The processing times can be measured in hours for some slow pyrolysis processes used for charcoal production. The distribution of the three main products from slow pyrolysis of wood on a weight basis is approximately 30-33% liquid, 33-35% char and 33-35% gas.

A more modern form of pyrolysis, termed fast pyrolysis, was discovered in the late 1970's when researchers noted that an extremely high yield of a relatively non-viscous liquid (i.e., a liquid that readily flows at room temperature) was possible from biomass. In fact, liquid yields approaching 80% of the weight of the input woody biomass material were possible if the pyrolysis temperatures were moderately raised and the conversion was allowed to take place over a very short time period, typically less than 5 seconds. In general, the two primary processing requirements to meet the conditions for fast pyrolysis are very high heat flux to the biomass with a corresponding high heating rate of the biomass material, and short conversion times followed by rapid quenching of the product vapor. Under the conditions of fast pyrolysis of wood the yields of the three main products are approximately, 70-75% liquid, 12-14% char, and 12-14% gas. The homogeneous liquid product from fast pyrolysis, which has the appearance of espresso coffee, has since become known as bio-oil. Bio-oil is suitable as a fuel for clean, controlled combustion in boilers, and for use in diesel and stationary turbines. This is in stark contrast to slow pyrolysis, which produces a thick, low quality, two-phase tar-aqueous mixture in very low yields.

In practice, the fast pyrolysis of solid biomass causes the major part of its solid organic material to be instantaneously transformed into a vapor phase. This vapor phase contains both non-condensable gases (including methane, hydrogen, carbon monoxide, carbon dioxide and olefins) and condensable vapors. It is the condensable vapors that, when condensed, constitute the final liquid bio-oil product, and the yield and value of this bio-oil product is a strong function of the method and efficiency of the downstream capture and recovery system. The condensable vapors produced during fast pyrolysis will continue to react as long as they remain at elevated temperatures in the vapor phase, and therefore must be quickly cooled or "quenched" in the downstream process. If the desired vapor products are not rapidly quenched shortly after being produced, some of the constituents will crack to form smaller molecular weight fragments such as non-condensable gaseous products and solid char, while others will recombine or polymerize into undesirable high-molecular weight viscous materials and semi-solids.

As a general rule, the vapor-phase constituents will continue to react at an appreciable rate, and thermal degradation will be evident, at temperatures above 400° C. If a fast pyrolysis process is to be commercially viable, it is therefore extremely important to instantaneously quench the vapor stream, after a suitable reaction time, to a temperature below about 400° C. preferably less than 200° C. and more preferably less than 50° C. Such a requirement to rapidly cool a hot vapor stream is not easily accomplished in scaled-up commercial fast pyrolysis systems. As the rapid cooling is effected, certain components in the vapor stream (particularly the heavier fractions) tend to quickly condense on cooler surfaces (i.e., transfer lines and ducting to the condensers) causing deposition and fouling of the equipment, and also resulting in the creation of a mass of warm liquid where additional secondary polymerization and thermal degradation can occur. In these regions where there is a temperature gradient between the hot reaction temperature and the lower condenser temperature, it is therefore critical to mitigate against condensing vapor deposition and the occurrence of resultant unwanted thermal reactions. The condensation and deposition phenomena described above can also apply to the thermal conversion of petroleum, fossil fuel and other carbonaceous feedstocks (e.g., the thermal upgrading of heavy oil and bitumen).

Therefore, there is a need for systems and methods that reduce such deposition and mitigate secondary reactions.

SUMMARY

Described herein are systems and methods for reducing cumulative deposition and unwanted secondary thermal reactions in pyrolysis and other thermal conversion processes.

In an embodiment, a system comprises a device, referred to as a reamer, for removing product deposits between thermal conversion and condensation operations of a pyrolysis process. The reamer may comprise, but is not limited to, a mechanical reciprocating rod or ram, a mechanical auger, a drill bit, a high-temperature wiper, brush, or punch to remove deposits and prevent secondary reactions. Alternatively or in addition, the reamer may use a high-velocity curtain or jet (i.e., a hydraulic or pneumatic stream) of steam, product gas, recycle gas, other gas jet or non-condensing liquid to remove deposits. Preferably, the reamer removes deposits during the pyrolysis process allowing for continuous operation of the pyrolysis process.

The present invention is not limited to applications involving the fast pyrolysis of biomass feedstocks. The present invention can be used in the fast pyrolysis or rapid cracking of any carbonaceous feedstock that is subjected to fast thermal conversion, including the thermal conversion, refining, gasification, and upgrading of all biomass, petroleum and fossil fuel feedstocks. Furthermore, the present invention is not limited only to applications between the thermal conversion system and the condensing system, but includes other areas in the thermal process where a thermal gradient exists, and where products are thermally reactive and subject to unwanted deposition and secondary thermal reactions. For example, there are situations where a product gas, which is being recycled to the thermal conversion unit for various purposes, may contain some residual vapors that are subject to deposition and secondary thermal reactions. The present invention may also be applied to prevent such an occurrence.

The above and other advantages of embodiments of the present invention will be apparent from the following more detailed description when taken in conjunction with the accompanying drawings.

DETAILED DESCRIPTION

Figure 1:
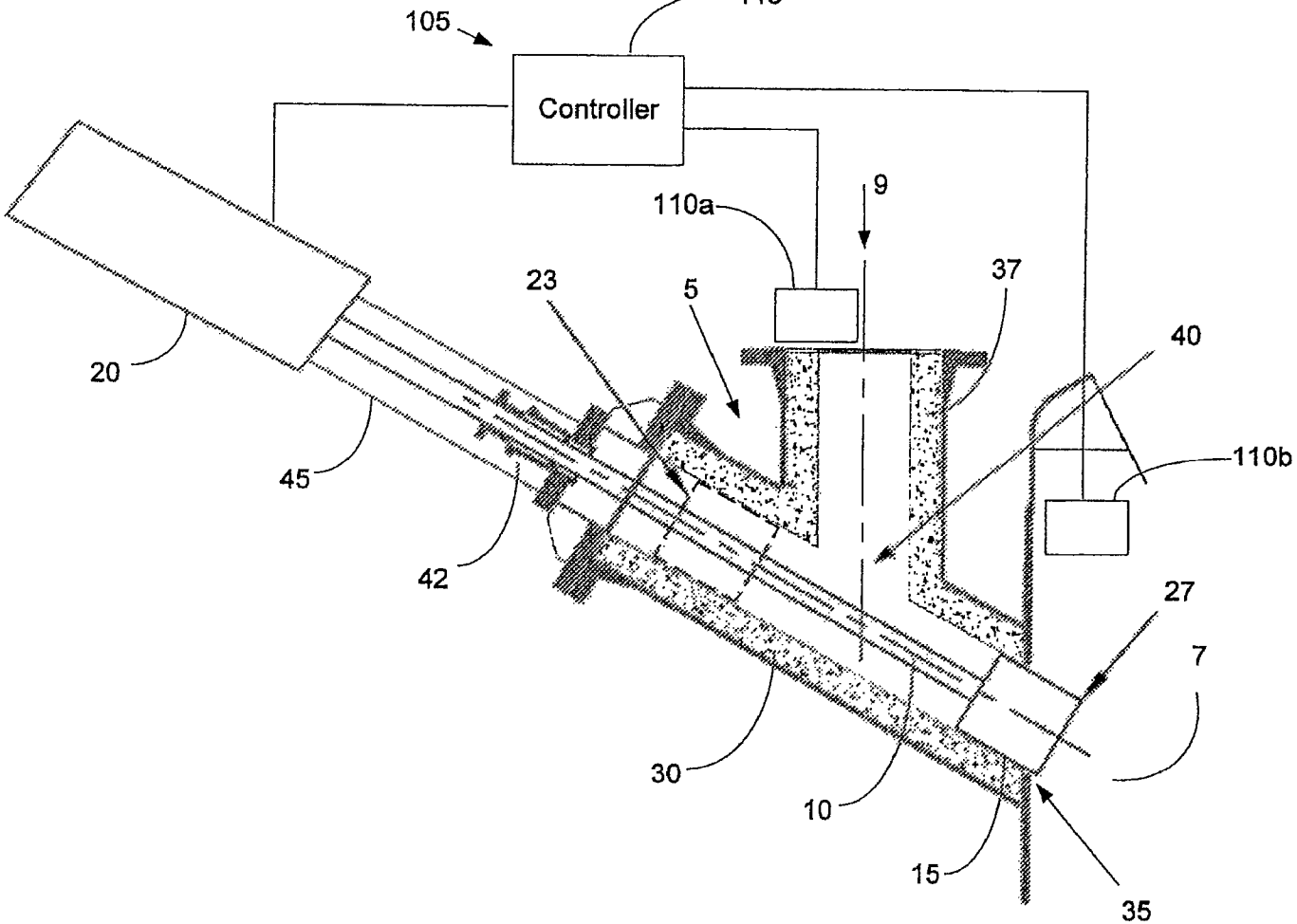
FIG. 1 is a schematic representation of a mechanical reamer with a reciprocating ram head according to an embodiment of the present invention.

FIG. 1 shows a mechanical reamer according to an exemplary embodiment of the present invention. In this exemplary embodiment, the reamer is configured to clear material build up in a pipeline 5 used for transporting a hot vapor stream to a condensing column or chamber 7 in a pyrolysis process. Details of an exemplary pyrolysis process in which the reamer can be used are given in co-pending application Ser. No. 11/943,329, titled "Rapid Thermal Conversion of Biomass," filed on Nov. 20, 2007, the specification of which is incorporated herein by reference.

The hot vapor stream flows through the pipeline 5 in the direction 9, and enters the condensing camber 7 where the hot vapor stream is quenched with a cool liquid to condense the hot vapor into a liquid product. A hot-cold interface zone forms around the interface between the pipeline 5 and the condensing camber 7. Due to the hot-cold interface zone, deposition of solid material (not shown) in the pipeline 5 occurs in the hot-cold interface zone. In one embodiment, the hot vapor stream comprises vaporized biomass (e.g., wood) that deposits solid carbonaceous material in the pipeline 5 in the hot-cold interface zone. As the deposited material builds up in the pipeline 5, the flow of vapor in the pipeline 5 is impeded. In this embodiment, the reamer is activated to clear the deposited material from the pipeline 5 during operation when a pressure differential across the hot-cold interface zone reaches a certain level.

Figure 3:
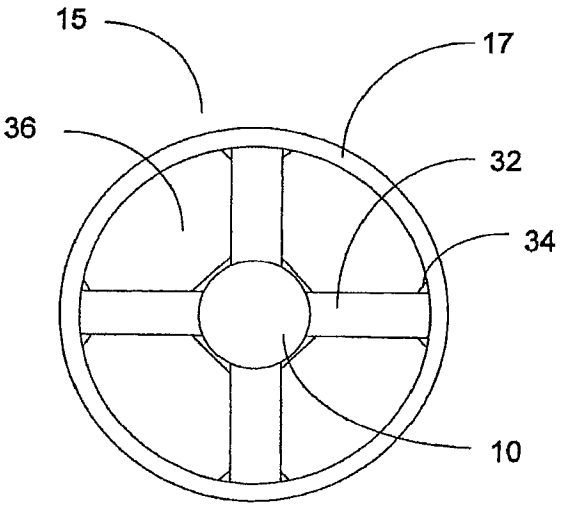
FIG. 3 shows a front view of the ram head of the mechanical reamer according to an embodiment of the present invention.
Figure 2:
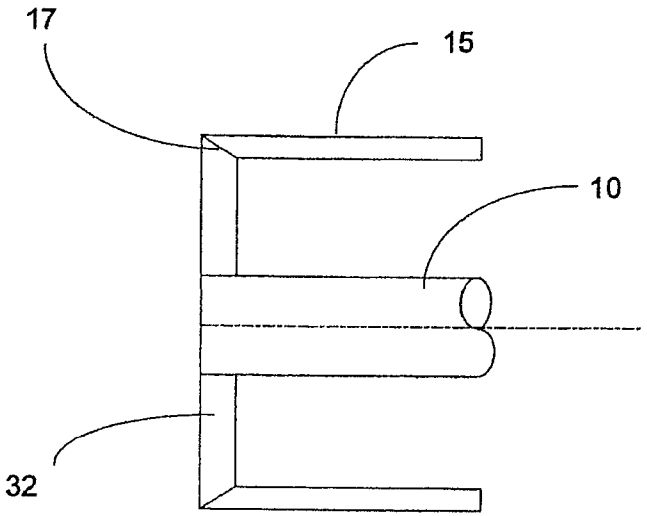
FIG. 2 shows a cross-sectional view of the ram head of the mechanical reamer according to an embodiment of the present invention.

Referring to FIGS. 1-3, the reamer comprises a rod or shaft 10, a ram head 15 attached to one end of the rod 10, and a mechanical actuator 20 mechanically coupled to the other end of the rod 10 for moving the rod 10 and ram head 15 in a reciprocating motion between a retracted position 23 and an extended position 27. Exemplary mechanical actuators include, but are not limited to, rack and pinion, hydraulic, or pneumatic actuators. In this embodiment, the pipeline 5 includes a section 30 coupled to the inlet port 35 of the chamber 7 at an angle. The angle facilitates the removal of the deposits by allowing gravity to deliver into the proximate high-velocity product stream. The ram head 15 and rod 10 of the reamer move within this section 30 of the pipeline 5. The mechanical actuator 20 is mounted on a bracket 45 that is bolted to a closed end of this section 30 of the pipeline 5. Another section of the pipeline 37 coupled to the source of the vapor stream is coupled to section 30 of the pipeline 5 at approximately the midpoint. In the retracted position 23, the ram head 15 is positioned behind the region where sections 30 and 37 of the pipeline 5 are coupled to facilitate the flow of hot vapor through the pipeline 5 when the reamer is not in use. The reamer includes a seal 42 around the rod 10 at the point the rod 10 enters the pipeline 5. The seal 42 allows the rod 10 to reciprocate while sealing the pipeline 5 from the outside to maintain a seal between the process and the atmosphere. The seal 42 may comprise a mechanical seal or a high temperature packing glad, e.g., that uses graphite as a packing material around the rod.

Referring to FIGS. 2 and 3, the ram head 15 is generally cylindrical with a beveled front edge 17 to break the deposited material, which may be hard and somewhat sticky. Other shapes or devices may be used for the front edge besides a beveled shape. Examples include, but are not limited to, a spinning auger, cutting head, spinning wire, brush, high-temperature wiper, drill bit, etc. The ram head 15 is attached to the rod 10 by four spokes 32 that are welded 34 to the inner surface of the ram head 15 and the rod 10. The ram head 15 may be attached to the rod 10 using a different number of spokes. Between the spokes 32 are openings 36 that allow vapor to flow though the ram head 15. The open cross-sectional area is preferably at least 30% of the total cross-sectional area of the pipeline, and more preferably 80%. These opening 36 allow the reamer to operate while vapor flows through the pipeline 5. As a result, the reamer is able clear material from the pipeline 5 without having to stop the pyrolysis process allowing for continuous operation.

The clearance between the ram head 15 and the inner wall of the pipeline 5 is preferably between 0.125" and 0.500" inches, and more preferably 0.250" inches. The clearance should be small to clear as much of the cross-sectional area of the pipeline as possible, but not so small that the ram head 15 impacts the inner wall of the pipeline 5.

Preferably, the ram head 15, spokes 32, and rod 10 are made of a robust high strength material that can withstand the hot vapor environment in the pipeline 5. Suitable materials include, but are not limited to, stainless steel alloys. Preferably, areas of the ram head 15 subjected to wear are made of a high strength alloy and/or treated by hard surfacing. For example, a tungsten-carbide hard surface may be applied to the ram head 15.

FIG. 1 shows a diagram of a control system 105 for the reamer according to an embodiment of the invention. The control system 105 is configured to activate the reamer when the deposited material in the pipeline 5 impedes the vapor flow by a certain amount. In this exemplary embodiment, the control system 105 includes at least two pressure sensors 110*a* and 110*b* positioned at different ends of the hot-cold interface zone. The control system 105 also includes a controller 115, e.g., computer system, coupled to the pressures sensors 110*a* and 110*b* and the reamer. The controller 105 uses the pressure readings from the pressure sensors 110*a* and 110*b* to measure and monitor the differential pressure across the hot-cold interface zone during operation. As the deposited material in the pipeline 5 chokes the vapor flow, the differential increases. When the measured differential pressure (dP) reaches a predetermined level (e.g., a maximum dP), the controller 115 activates the reamer and starts the clearing operation, in which the ram head 15 of the reamer is moved in a reciprocating motion by the mechanical actuator 20 to clear the deposited material from the pipeline 5. The clearing opening is performed while the vapor flows through the pipeline 5 and the openings of the ram head 15. This allows the pyrolysis process to continue during the clearing operation. Preferably, the speed of the ram head 15 is controlled to avoid impact damage of the pipeline 5 by the ram head 15. Insertion rate or stroke rate be controlled, by way of example, through the use of a needle valve on the actuator assembly of the reamer. Stroke rate is adjusted to limit the disturbance to the vapor and non-condensable gas stream while minimizing the mechanical stresses to the pipe works and associated reamer assembly. The stroke rate is typically adjusted to less than 50 ft/s, more preferably to less than 10 ft/s, and more preferably to less than 1 ft/s. The controller 115 monitors the differential pressure during the clearing operations and stops the clearing operation when the differential pressure drops below a predetermined level indicating that the pipeline 5 is clear. When this occurs, the ram head 15 is retracted to the retracted position 23.

To further minimize the condensation of materials from the hot vapor stream, the pipeline 5 may be refractory lines or insulated to avoid unwanted heat losses. In addition, the pipeline 5 may be heat traced to maintain the desired transfer line temperature to further minimize condensable vapor deposition. The pipeline temperature should be kept above 400 C, preferably above 450, and more preferably above 500 C up to the point where quenching is desired.

The reamer according to this embodiment of the invention provides several advantages. By clearing the deposited material from the pipeline the reamer prevents blockages that can lead to system shut down. Further, the reamer clears the deposited material during operation allowing for a continuous pyrolysis process. In other words, the pyrolysis process does not need to stop for the reamer to clear the deposited material. Further, by keeping the pipeline clear during the process the reamer maintains more consistent operating conditions during the process and prevents high pressure build up in the pipeline due to blockage.

Figure 4:
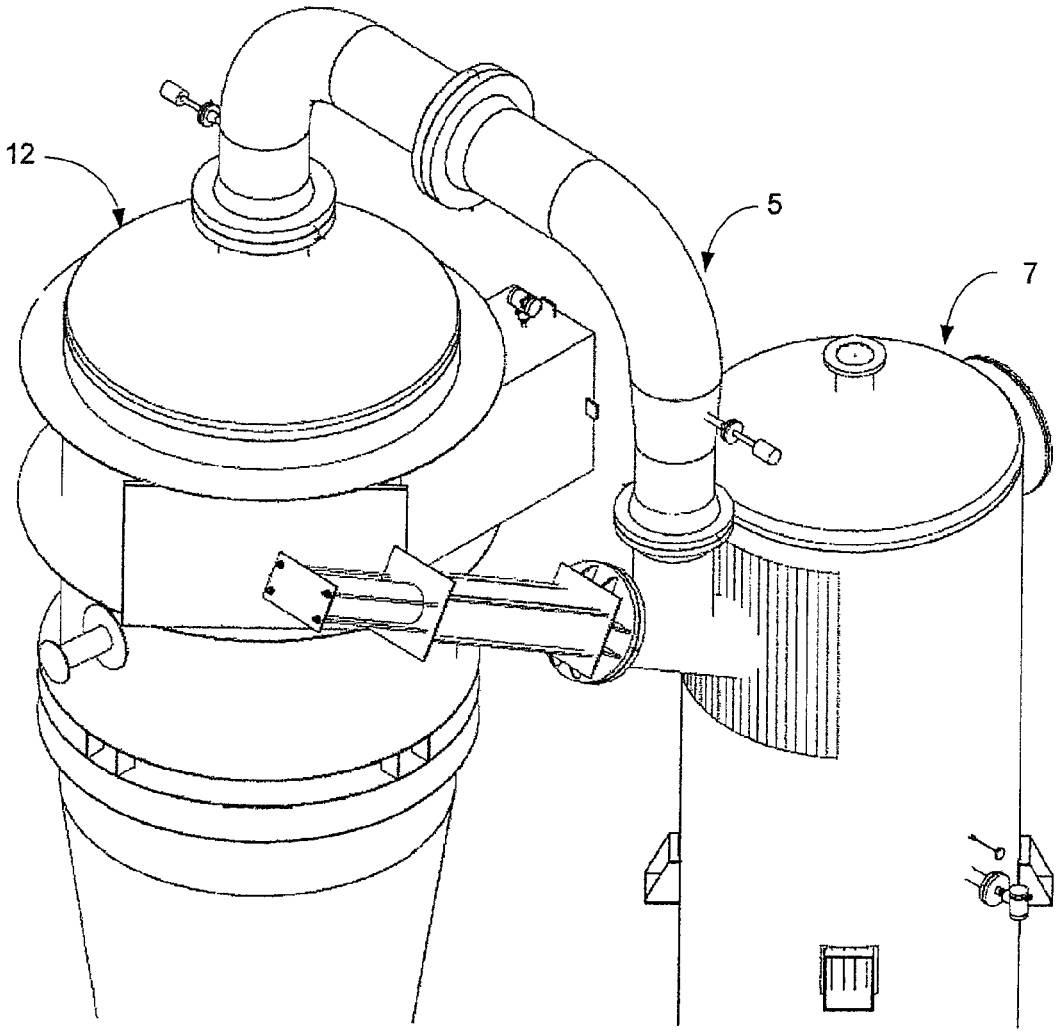
FIG. 4 shows the mechanical reamer installed in a pyrolysis process according to an embodiment of the present invention.

FIG. 4 shows an example of the reamer coupled to a pipeline 5 between a cyclonic separator 12 and a condensing chamber 7. In this example, the cyclonic separator 12 separates the hot vapor stream from heat carriers (e.g., sand) used to thermally covert the feedstock (e.g., biomass) into the hot vapor stream in a thermal conversion process. The condensing chamber 7 quickly quenches the incoming hot vapor stream into liquid product, which creates the hot-cold interface zone. The reamer advantageously removes product deposits that form in the pipeline 5 due to the hot-cold interface zone, and thereby prevents unwanted increases in system back pressure and unwanted secondary reactions. The reamer may be located in other areas in the thermal process where a thermal gradient exists, and where products are thermally reactive and subject to unwanted deposition and secondary thermal reactions.

Figure 5:
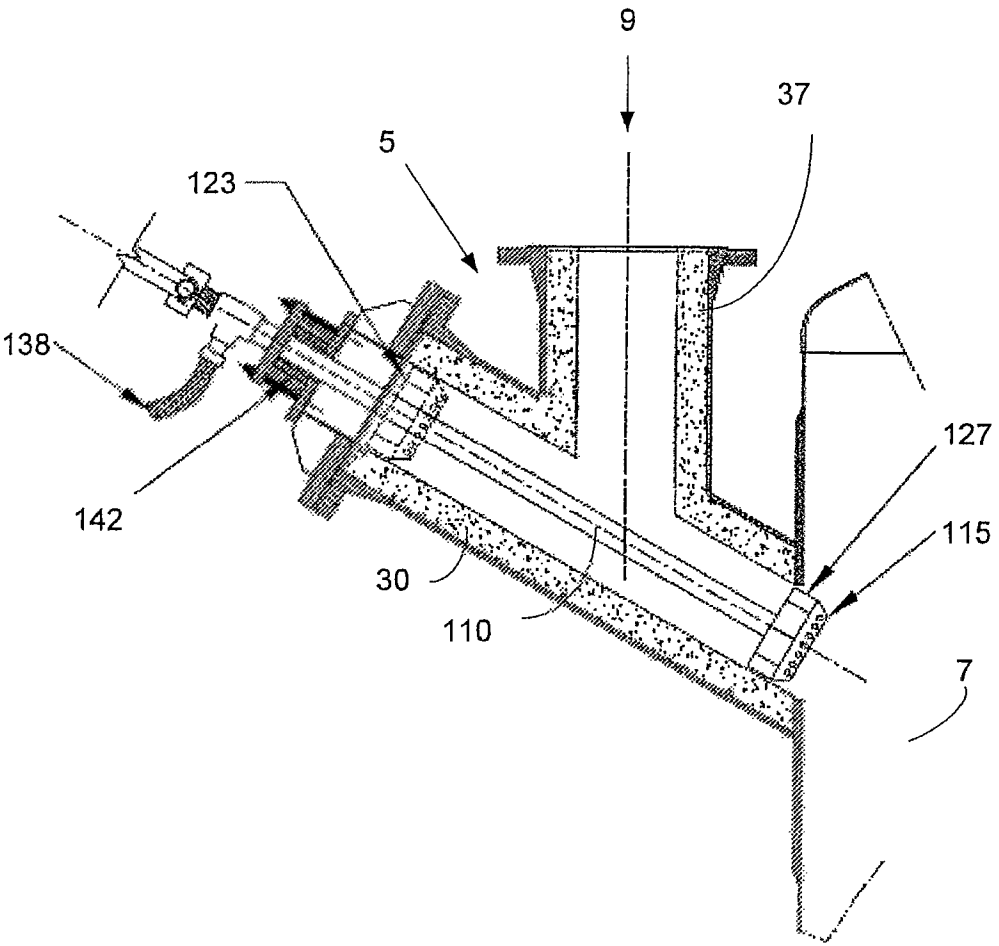
FIG. 5 is a schematic representation of a mechanical reamer having a high pressure nozzle head according to an embodiment of the present invention.

In another embodiment shown in FIG. 5, a movable reamer having a high pressure nozzle head 115 uses high-velocity gaseous, vapor or liquid jet or stream to remove deposits of condensed product vapors. In this case, the stream is injected at a velocity of between 50 to 500 feet/second (fps) to dislodge the condensed product, e.g., from the pipeline at or near a hot-cold interface. More preferably, a velocity of 100 to 200 fps is used and most preferably, a velocity in the range of 100 to 150 fps is used. In the example shown in FIG. 5, the movable high pressure nozzle head 115 is attached to the end of a rod 110, which moves the nozzle head 115 between the retracted position 123 and the extended position 127 during the clearing operation. The rod 110 and nozzle head 115 may be moved via a pneumatic or hydraulic system. A seal 142 (e.g., packing glad) forms a seal around the pipeline at the point where the rod 110 enters the pipeline. During the clearing operation, a high-velocity stream is injected into the pipeline from the high pressure nozzle head 115 to dislodge deposits from the pipeline. The nozzle head 115 receives the high-velocity stream through a lumen in the rod 110 that is fluidly coupled to a supply line 138 (e.g., a braided flex line) outside the pipeline. The high pressure stream may be supplied by an air compressor, recycled gas (e.g., a inert by-product gas stream) steam, nitrogen or other gaseous or vapor stream.

Figures 6, 7:
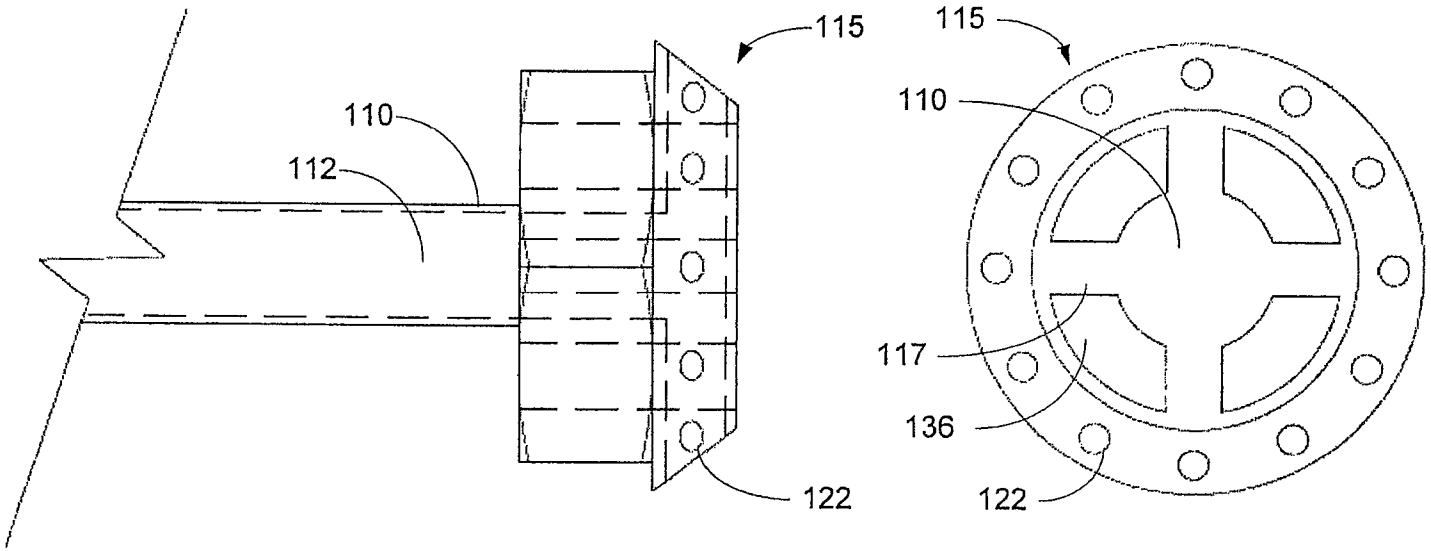
FIG. 6 shows a side view of the high pressure nozzle head according to an embodiment of the present invention.
FIG. 7 shows a front view of the high pressure nozzle head according to an embodiment of the present invention.

FIGS. 6 and 7 show a side view and a front view of the nozzle head 115, respectively, according to an embodiment of the invention. The nozzle head 115 comprises a plurality of injection holes 122 arranged circumferentially along a tapered portion 125 of the nozzle head 115 for injecting the high pressure stream onto the pipeline wall. The nozzle head 115 is attached to the rod 110 by a plurality of support members 117. The support members 117 have lumens fluidly coupled to the lumen 112 of the rod for supplying the high pressure stream to the nozzle head 115. Openings 136 between the support members 117 allow the hot vapor stream of the pyrolysis process to flow through the nozzle head 115 during the clearing operation. This advantageously allows the reamer to clear deposits from the pipeline wall without having to stop the pyrolysis process.

Figure 8:
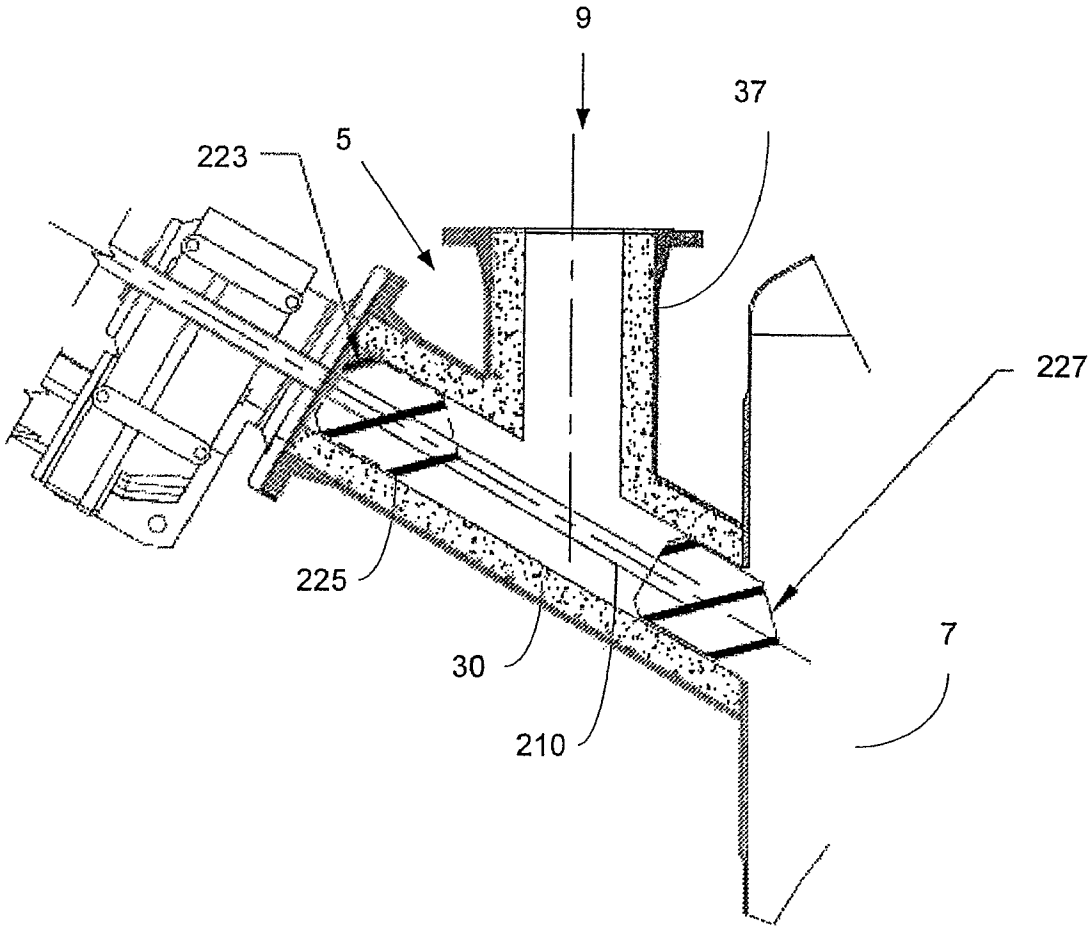
FIG. 8 is a schematic representation of a mechanical reamer with an auger according to an embodiment of the present invention.

FIG. 8 shows a reamer according to another embodiment of the present invention. In this embodiment, the reamer comprises a rotating auger 225 (e.g., a helical shaft) to clear deposits from the pipeline 5. When the reamer is activated, the rod 210 extends the auger 225 from a retracted position 223 to an extended position 227 while rotating the auger 225 to remove the deposits from the pipeline. The auger 225 can be rotated by an electric motor, an air driven motor or other driver known in the art. The rod 110 and the auger 225 may be moved between the retracted and extended positions via a pneumatic or hydraulic system. The reamer may be activated when a sensed pressure differential exceeds a certain level in a manner similar to the embodiment shown in FIG. 1. Preferably, the hot product stream is allowed to flow through the helical structure of the auger 225 for continuous operation of the pyrolysis process.

Figure 9:
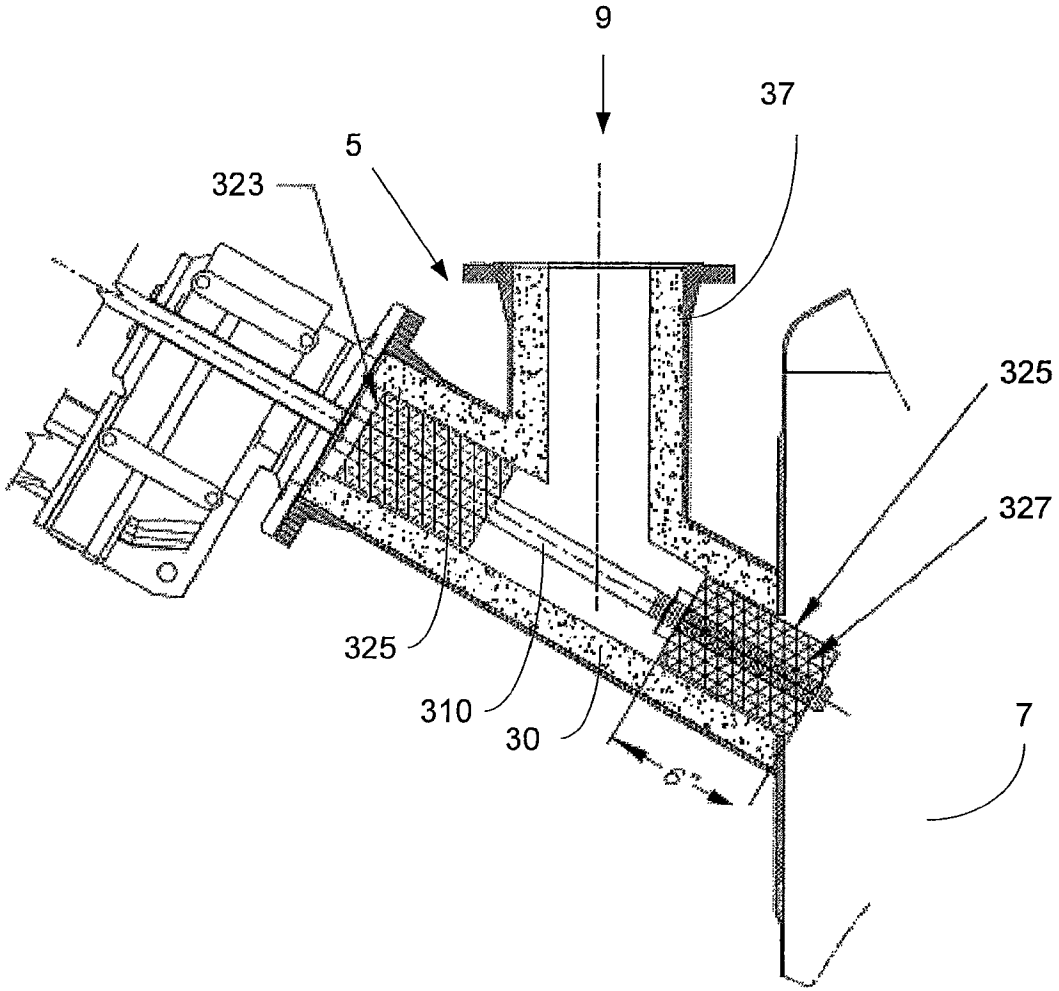
FIG. 9 is a schematic representation of a mechanical reamer with an wire brush head according to an embodiment of the present invention.

In another embodiment, a reamer having a wire brush head assembly 326 is used scour the wall of the pipeline to remove deposits of condensed product vapors, as shown in FIG. 9. The wire bush head assembly 325 may be constructed of a high temperature, flexible abrasive resistant material such as stainless steel. When the reamer is activated, the rod 310 extends the wire brush head 325 from the retracted position 323 to the extended position 327 to scour the pipeline walls. The movement of the rod 310 and brush head 325 in this embodiment may be via a pneumatic or hydraulic system. The brush head 325 can be extended and retracted with or without a spinning action. If spinning action is used, the brush head 325 can be rotated by an electric motor, an air driven motor or other driver known in the art. An interference fit may be used to fit the brush head 325 within the pipeline to provide enough contact between the brush head 325 and the pipeline wall to remove deposited materials on the pipeline wall. Preferably, the hot product stream is allowed to flow through the brush head 325 for continuous operation of the pyrolysis process.

The rotational speed of the auger 225 or spinning brush head 325 may be 10 to 500 rpm, preferably 50 to 250 rpm, and more preferably between 50 and 150 rpm. The more preferably range allows for adequate reduction of deposited materials while reducing the wear of the rotation equipment.

Although the present invention has been described in terms of the presently preferred embodiments, it is to be understood that the disclosure is not to be interpreted as limiting. Various alterations and modifications will no doubt become apparent to those skilled in the art after having read this disclosure. Accordingly, it is intended that the appended claims be interpreted as covering all alterations and modifications as fall within the spirit and scope of the invention.

What is claimed is:

1. A system for removing deposits in a pyrolysis process or other thermal conversion process, comprising:

i) a pipeline fluidly coupled between a high temperature zone and a low temperature zone in the pyrolysis process or other thermal conversion process, wherein the pyrolysis process or other thermal conversion process produces a first vapor stream that flows through the pipeline; and ii) a reamer coupled to the pipeline, wherein the reamer is configured to remove deposits from the pipeline during the pyrolysis process or other thermal conversion process; said reamer comprising:

a) a rod;

b) a ram head, wherein the ram head interior surface is coupled to the exterior surface of one end of the rod defining an opening of at least 30% of the total cross-sectional area of the pipeline, wherein the opening is adapted to allow the first vapor stream to pass through the ram head and the pipeline; and c) a mechanical actuator coupled to the other end of the rod, wherein the mechanical actuator is configured to reciprocate the rod and the ram head within the pipeline.

2. The system of claim 1, wherein the ram head has a beveled front end.

3. The system of claim 1, wherein the reamer is configured to inject a gaseous, liquid or second vapor stream into the pipeline to remove the deposits, wherein the gaseous, liquid or second vapor stream is received from a supply line.

4. The system of claim 1, further comprising:

a first pressure sensor;

a second pressure sensor, wherein there is a temperature gradient between the first and second pressure sensors; and a controller coupled to the reamer and the first and second pressure sensors, wherein the controller is adapted to monitor a pressure deferential between the first and second pressure sensors, and to activate the reamer when the monitored pressure deferential reaches a certain level.

5. The system of claim 1, wherein the coupling between the ram head interior surface and the exterior surface of one end of the rod comprises a plurality of spokes.

6. The system of claim 5, wherein the plurality of spokes define a plurality of openings adapted to allow the first vapor stream to pass through the ram head and the pipeline.

* * * * *